US010246969B2

(12) United States Patent
Cowie et al.

(10) Patent No.: US 10,246,969 B2
(45) Date of Patent: Apr. 2, 2019

(54) VALVE APPARATUS

(71) Applicant: Interventek Subsea Engineering Limited, Aberdeen (GB)

(72) Inventors: Gavin David Cowie, Aberdeenshire (GB); John David Sangster, Aberdeen (GB)

(73) Assignee: Interventek Subsea Engineering Limited, Aberdeen (GB)

( * ) Notice: Subject to any disclaimer, the term of this patent is extended or adjusted under 35 U.S.C. 154(b) by 0 days.

(21) Appl. No.: 15/317,675

(22) PCT Filed: Jun. 23, 2015

(86) PCT No.: PCT/GB2015/051826
§ 371 (c)(1),
(2) Date: Dec. 9, 2016

(87) PCT Pub. No.: WO2016/001628
PCT Pub. Date: Jan. 7, 2016

(65) Prior Publication Data

US 2017/0138152 A1 May 18, 2017

(30) Foreign Application Priority Data

Jun. 30, 2014 (GB) ..... 1411636.2

(51) Int. Cl.
*E21B 33/06* (2006.01)
*E21B 34/04* (2006.01)
(Continued)

(52) U.S. Cl.
CPC ..... *E21B 34/045* (2013.01); *E21B 29/04* (2013.01); *E21B 29/08* (2013.01); *E21B 33/063* (2013.01);
(Continued)

(58) Field of Classification Search
CPC ..... E21B 34/045; E21B 33/063; E21B 34/04; E21B 34/00; E21B 34/002; E21B 34/005; E21B 29/04; E21B 29/08
See application file for complete search history.

(56) References Cited

U.S. PATENT DOCUMENTS 1,648,107 A * 11/1927 Brogdon ..... E21B 29/08 137/318
5,161,617 A * 11/1992 Marschke ..... E21B 29/08 137/318
(Continued)

FOREIGN PATENT DOCUMENTS

GB 820566 A 9/1959
WO WO-92/16714 A1 10/1992
WO WO-2016001628 A1 1/2016

OTHER PUBLICATIONS

International Search Report PCT/ISA/210 for International Application No. PCT/GB2015/051826 dated Nov. 19, 2015.
(Continued)

*Primary Examiner* — Umashankar Venkatesan
(74) *Attorney, Agent, or Firm* — Harness, Dickey & Pierce, P.L.C.

(57) ABSTRACT

A valve apparatus (10) comprises a housing (12) defining a flow path (14), a valve seat (42) located within the housing (12) around a periphery of the flow path (14), a carriage member (16) located within the housing (12), a cutting arrangement (28) mounted on the carriage member (16), and a valve member (32) mounted on the carriage member (16) via a connection assembly (34) which permits relative movement between the valve member (32) and the carriage member (16). The carriage member (16) is moveable from a first position towards a second position to drive the cutting arrangement (28) across the flow path (14) and to move the valve member (32) into a position in which relative move-
(Continued)

ment between the valve member (32) and the carriage member (16) permits the valve member (32) to sealingly engage and disengage the valve seat (42) to control flow along the flow path (14).

29 Claims, 11 Drawing Sheets

(51) Int. Cl.
*E21B 29/04* (2006.01)
*E21B 29/08* (2006.01)
*E21B 34/00* (2006.01)

(52) U.S. Cl.
CPC ..... *E21B 34/00* (2013.01); *E21B 34/04* (2013.01); *E21B 2034/002* (2013.01); *E21B 2034/005* (2013.01)

(56) References Cited

U.S. PATENT DOCUMENTS 5,199,493 A * 4/1993 Sodder, Jr. ..... E21B 29/08 166/297
5,284,209 A 2/1994 Godfrey
5,327,923 A * 7/1994 Eischen ..... F16K 43/00 137/15.14
7,422,055 B2 * 9/2008 Cruickshank ..... E21B 29/04 166/54.5
9,097,082 B2 * 8/2015 Hoang ..... E21B 29/04
2009/0045368 A1 2/2009 Cowie et al.
2013/0327536 A1 12/2013 Alexander et al.
2015/0144354 A1 * 5/2015 Cooper ..... E21B 31/00 166/377

OTHER PUBLICATIONS

Written Opinion of the International Searching Authority PCT/ISA/237 for International Application No. PCT/GB2015/051826 dated Nov. 19, 2015.
Great Britain Search Report for Great Britain Application No. GB1411636.2 dated Dec. 17, 2014.
Australian Examination Report for corresponding Application No. 2015282447 dated Dec. 18, 2018.

* cited by examiner

VALVE APPARATUS

CROSS-REFERENCE TO RELATED APPLICATIONS

This application is the U.S. National Phase application of PCT Application No. PCT/GB2015/051826 filed on Jun. 23, 2015, which claims priority to Great Britain Application No. 1411636.2 filed on Jun. 30, 2014 the entire contents of each of which are incorporated herein by reference.

FIELD OF THE INVENTION

The present invention relates to a valve apparatus, such as a valve apparatus for use in subsea applications, such as in a Sub Sea Test Tree (SSTT).

BACKGROUND TO THE INVENTION

Valves are used in numerous applications across a number of industries, primarily for flow/pressure control purposes. For example, in the oil and gas industry valves are used extensively in both upstream and downstream applications. Valves may be employed in a downhole environment, such as in sub-surface safety valves (SSSV), downhole chokes, drill stem test valves and the like. Also, valves are typically used in topside applications, such as in wellhead equipment, for example in production trees, blow out preventers (BOPs) and the like.

When performing certain procedures on oil and gas wells, such as during workover or intervention operations, running completions, clean-up, abandonment and the like, it is necessary to utilise valves which are capable of isolating the formation from surface. Such valves may need to provide the capability to both contain fluids under pressure and also cut obstructions, such as wireline, coiled tubing, tool strings, or the like which extend through the valves. A variety of different valves are used for this so called shear and seal purpose, with the particular type selected dependent on variables such as the wellhead infrastructure and the nature of the wellbore operation.

In some instances where a marine riser is utilised to facilitate wellbore operations such as deploying completions or performing wellbore interventions, a so called landing string assembly is typically used, which extends inside the riser from surface to the wellhead, normally landed-out in a wellhead tubing hanger. This landing string may be used as a contained passage to permit fluids and/or equipment to be deployed from surface, and/or may be used to deploy wellbore equipment, such as completion strings, into the associated wellbore.

The landing string typically includes an upper section composed primarily of tubing, and a lower section which includes various valves for providing well control. For example, landing strings typically include a valve assembly called a subsea test tree (SSTT), which must provide a shear and seal functionality.

In many instances landing strings need to be sized and arranged not only to be deployed through a marine riser, but also to be accommodated within wellhead equipment, such as within BOP stacks. For example, the SSTT is typically located within the confines of the BOP, such that the outer dimensions of the SSTT are limited. Also, the axial extent of the SSTT needs to be such that, normally, it must be positioned between individual BOP rams, thus placing axial length size restrictions.

Further, the industry is increasing the requirements for such valves. Notably, emerging specifications such as ISO 13628-7 and API 17G are demanding that the structural integrity of such valves be improved to provide increased fatigue performance. The typical arrangement of current valves utilise much more of the available space to provide the existing functionality. For in-riser applications, there can be very little room to provide the additional functionality demanded by the industry codes.

Numerous valve designs exist, such as ball valves, flapper valves, ram valves, and the like. Each valve design has associated advantages and disadvantages, and often the particular design selected is very much dependent on the required application.

Ram valves, such as might be used in BOPs, have good cutting and post cut sealing capabilities, but typically require large projecting actuators which restricts their application, for example precluding the possibility of through riser deployment.

Ball valves can be diametrically compact, and thus permit use in through riser deployment applications. However, where ball valves also must have a cutting capability, post-cut sealing is often not guaranteed, for example as the cutting edge of the ball valve may be deformed, such that during the process of closing/opening the deformed cutting edge damages, for example by scoring, a cooperating sealing surface of a valve seat. Also, ball valves, particularly those used in SSTTs normally have associated internal linear actuators, which requires increased axial length, which can limit their ability to be installed in certain BOP stacks. Also, such internal actuators typically utilise elastomer type seals, which can suffer in the high pressures and temperatures normally associated with wellbores.

Flapper valves are generally accepted as being simple, reliable and trusted, and are well established in permanent barrier roles, such as in SSSV applications. However, a significant limitation of flapper valves is their ability to cut objects. Further, the nature of current flapper valves is such that their sealing surfaces are normally exposed to fluid flow when they are open, exposing them to damage with a possible compromise in sealing integrity when closed.

SUMMARY OF THE INVENTION

Aspects of the present invention relate to a valve apparatus. Such a valve apparatus may be utilised in any flow control application, and may, for example, be of use in flow control applications associated with the exploration and production of hydrocarbons from subterranean formations. For example, the valve apparatus may be used or incorporated within a landing string, such as within a subsea test tree (SSTT), retainer valve or the like. The valve apparatus may be used or incorporated in a lubricator valve, subsurface safety valve (SSSV), drill stem test valve or the like.

The valve apparatus may include a valve member which may cooperate with a valve seat to control flow along an associated flow path. Such a valve member may be mounted on a moveable carriage, such that the position of the valve member may be varied by movement of the carriage. The valve member may be moveable relative to the moveable carriage. For example, the valve member and the moveable carriage may define at least one degree of freedom therebetween.

The carriage may be moveable such that in a first position the valve member is prevented from cooperating with the valve seat, and in a second position the valve member is permitted to cooperate with the valve seat and thus vary flow. When the carriage is in its second position the valve member may move relative to the carriage to selectively sealingly engage the valve seat.

The valve apparatus may include a cutting arrangement for use in cutting an object positioned within an associated flow path. The moveable carriage may include a cutting arrangement, such as a shearing cutting arrangement, wherein movement of the carriage may facilitate cutting of an object located within an associated flow path. In one embodiment movement of the carriage from its first position to its second position may facilitate cutting of an object located within the flow path, and at the same time position the valve member to cooperate with the valve seat. Accordingly, the valve apparatus may provide a cut and seal functionality.

An aspect of the present invention relates to a valve apparatus, comprising:

a housing defining a flow path;

a valve seat located within the housing around a periphery of the flow path;

a carriage member located within the housing;

a cutting arrangement mounted on the carriage member; and a valve member mounted on the carriage member via a connection assembly which permits relative movement between the valve member and the carriage member, wherein the carriage member is moveable from a first position towards a second position to drive the cutting arrangement across the flow path and to move the valve member into a position in which relative movement between the valve member and the carriage member permits the valve member to sealingly engage and disengage the valve seat to control flow along the flow path.

Accordingly, in use the carriage member may be located within its first position to maintain the flow path open, permitting flow and objects to pass along the flow path. In the event of a requirement to control flow along the flow path the carriage member may be moved from its first position towards its second position. Such movement in driving the cutting arrangement across the flow path will facilitate cutting of any object located within the flow path. Further, when the carriage member is located in its second position the valve member may then be operable, by virtue of its permitted relative movement with the carriage member, to selectively sealingly engage the valve seat, closing, or restricting the flow path. In this way the valve apparatus may advantageously function as a cut and seal valve assembly.

The valve apparatus may be operable to cut various objects located within the flow path, such as wireline, slickline, cable, braided wire, tools, rods, tubular members such as coiled tubing and the like.

When the carriage member is located within its first position the valve member may be prevented from cooperating with the valve seat to provide any flow control along the flow path.

When the carriage member is located within its first position the valve member may be located or positioned within a storage or non-operational configuration. When the carriage member is located within its second position the valve member may be located or positioned within an operational position, in which relative movement between the valve member and the carriage member permits the valve member to sealingly engage and disengage the valve seat.

When the carriage member is located within its first position the valve member may be at least partially isolated from fluid and/or objects in the flow path, thus providing a degree of protection to the valve member. This may assist to avoid or minimise sealing issues when the valve member is positioned to sealingly cooperate with the valve seat.

The apparatus may comprise a pocket for receiving or accommodating the valve member when the carriage member is located within its first position. The pocket may be defined by a recess. The pocket may be defined by a slot or channel formed in a wall of the housing. The pocket may extend from the flow path, for example merge with the flow path. The pocket may be offset from the flow path, for example laterally offset. The pocket may function to guide a translation movement of the valve member during movement of the carriage member between first and second positions. For example, the recess may define a set path of movement of the valve member as the carriage member is moved. Such path of movement may be a linear path, arcuate path or the like.

The pocket may be defined on one lateral side of the flow path. The pocket may be defined by an annular recess around the circumference of the flow path.

The cutting arrangement may comprise a shearing cutting arrangement, configured to cut an object contained within the flow path by a shearing action.

The cutting arrangement may comprise a cutting edge, configured to engage and cut an object within the flow path. The cutting edge may comprise a lip. The cutting edge may comprise a knife edge, configured to penetrate an object during cutting. The cutting edge may define a continuous edge profile. The cutting edge may define a discontinuous edge profile. The cutting edge may define a shaped edge, such as a shape to assist in cutting an object. For example, the cutting edge may be shaped to pierce an object being cut.

The cutting arrangement may comprise first and second cutting edges each configured to cut an object. Such an arrangement may permit the cutting arrangement to cut a slug from an object positioned within the flow path. This arrangement may generate a gap between cut ends of an object to facilitate positioning of the valve member to sealingly engage the valve seat.

The cutting arrangement may be moved along a cutting path during movement of the carriage member between its first and second positions. The cutting path may define a cutting plane.

At least a portion of the cutting arrangement may be integrally formed with the carriage member.

In some embodiments the cutting arrangement may comprise a cutting insert which is mounted in or on the carriage member. The provision of an insert may allow use of different materials on the carriage member and the cutting insert, which may improve functionality, reduce costs and the like. For example, in some embodiments the cutting insert may comprise or be composed of a high strength and hardened material, such as a work hardening material, whereas the carriage member may comprise or be composed of a lower cost material, such as a lower cost ductile material. Further, the use of a cutting insert may assist in reducing redress costs, in that only the insert may need to be redressed and/or replaced, rather than the entire carriage member. Also, the use of a cutting insert may more readily permit the valve apparatus to be tailored for specific applications, for example by allowing a selection of different cutting inserts to be made, which may provide variety in terms of, for example, geometry, material and the like.

The valve apparatus may comprise a valve seat cutting arrangement mounted on or otherwise associated with the valve seat. The valve seat cutting arrangement may cooperate with the cutting arrangement mounted on the carriage member. In some embodiments the valve seat cutting arrangement may cooperate with the cutting arrangement mounted on the carriage member to establish a transverse shear stress in an object located within the flow path during movement of the carriage member from its first position towards its second position.

The valve seat cutting arrangement may define a cutting edge. The valve seat cutting arrangement may define first and second cutting edges.

In one exemplary use, movement of the carriage member from its first position to its second position may cause the cutting arrangement mounted on the carriage member to engage an object located within the flow path, pushing the object towards the valve seat cutting arrangement, with continuous relative movement between said cutting arrangements establishing a shear stress through the object, resulting in cutting. In some embodiments where the object is tubular in form, the object may be initially crushed by the relative movement between the cutting arrangements, prior to cutting.

The valve seat cutting arrangement and the cutting arrangement mounted on the carriage member may be spatially arranged relative to each other to define a shear plane or plane of cut. Accordingly, shear stress established within an object being cut may be substantially applied in this shear plane. This shear plane may be largely aligned with the path of travel of the cutting arrangement as the carriage member moves between its first and second positions.

The valve seat cutting arrangement and the cutting arrangement mounted on the valve member may be spatially arranged during operation to provide efficient cutting. For example, a minimum or preferred clearance between the cutting arrangements may be provided, which may assist in efficient cutting of objects such as braided cable strands, which may otherwise deform and bind within the clearance gap.

At least a portion of the valve seat cutting arrangement may be integrally formed with the valve seat.

At least a portion of the valve seat cutting arrangement may be provided by or on an insert, wherein said insert is mounted on, within, and/or adjacent to the valve seat. Similar benefits of using a cutting insert as defined above may also apply.

The carriage member may function to displace at least a portion of a cut object to minimise risk of the object from interfering with the ability of the valve member to sealingly engage the valve seat when the carriage member is located within its second position.

The valve apparatus may comprise a cutting pocket, such as a recess, which is configured to receive at least a portion of a cut object. Such a cutting pocket may permit at least a portion of a cut object to be moved away from the region of the valve seat, minimising interference with the valve member. The cutting pocket may receive a cut end of an object. The cutting pocket may receive a slug portion cut from an object.

The valve member may comprise or define a valve member sealing arrangement for sealing engagement with the valve seat. The valve member sealing arrangement may comprise a sealing surface. The sealing surface may extend around the periphery of the valve member. In such an arrangement, the valve member may be operable to occlude the flow path, with sealing achieved around the periphery of said valve member, and thus flow path. The valve member sealing surface may be shaped to compliment a shape of the valve seat. The valve member sealing surface may define a flat profile, curved profile or the like. In one embodiment the valve member sealing surface may be generally concave in profile. Alternatively, the sealing surface may be generally convex in profile.

The valve member sealing arrangement may comprise one or more seal members. At least one seal member may be mounted on or within a sealing surface of the valve member. For example, the valve member may define one or more recesses configured to receive one or more seal members. At least one seal member may be a non-elastomeric seal member. A non-elastomeric seal member may provide increased ability to accommodate pressure and temperature extremes. However, in some embodiments at least one seal member may be an elastomeric seal member.

When the carriage member is located within its first position the valve member may be positioned such that the sealing surface of the valve member is at least partially isolated from the flow path. This may assist to protect the sealing surface from damage during flow or passage of objects.

When the carriage member is located within its first position the valve member may be positioned such that the sealing surface is generally facing away from the flow path, which may provide protection to the sealing surface from flow and/or objects.

The valve apparatus may comprise a protection seat, wherein the valve member, such as a sealing surface of the valve member, is engagable with the protection seat when the carriage member is positioned within its first position. In this embodiment, when the valve member is engaged with the protection seat said valve member may be protected from exposure, and thus potential damage, to flow and/or objects along the flow path The valve seat may comprise or define a seat sealing arrangement for sealing engagement with the valve member. The seat sealing arrangement may comprise a sealing surface. The sealing surface may extend around the periphery of the flow path. The sealing surface may be shaped to compliment a shape of the valve member, such as the shape of a sealing surface of the valve member. The sealing surface may define a flat profile, curved profile or the like. In one embodiment the sealing surface may be generally concave in profile. Alternatively, the sealing surface may be generally convex in profile.

The seat sealing arrangement may comprise one or more seal members. At least one seal member may be mounted on or within a sealing surface of the valve seat. For example, the valve seat may define one or more recesses configured to receive one or more seal members. At least one seal member may be a non-elastomeric seal member. At least one seal member may be an elastomeric seal member.

The valve apparatus may comprise a wiper arrangement for use in wiping one or both of the valve seat and the valve member during movement of the carriage member between its first and second positions.

A valve seat wiper arrangement may be mounted on the carriage member for wiping a sealing surface of the valve seat during movement of the carriage member. The valve seat wiper arrangement may comprise a soft or compliant material. In one embodiment the valve seat wiper arrangement may comprise a polymer, such as a plastic material, for example PEEK.

The valve seat wiper arrangement may comprise a wiping member mounted on the carriage member. In one embodiment the wiping member may be positioned within a recess formed within the carriage member, such that a portion of the wiper member protrudes from the recess to establish interference with the sealing surface of the valve seat during movement of the carriage member. The valve seat wiper arrangement may establish compressive interference engagement with the sealing surface of the valve seat.

A valve member wiper arrangement may be mounted on or relative to the valve seat for wiping a sealing surface of the valve member during movement of the carriage member.

The ability of the valve member to move relative to the carriage member may permit the valve member to be positioned during movement of said carriage member from its first to second position to provide a degree of relief relative to a cut object located within the flow path. This may assist to minimise the risk of a cut edge of the object from engaging and possibly damaging the valve member during movement of the carriage member, which could otherwise compromise sealing of the valve member against the valve seat.

The cutting arrangement mounted on the carriage member may move along a cutting path when the carriage member is moved between its first and second positions. A clearance gap may be provided between the cutting path of the cutting arrangement and a sealing surface of the valve seat. Such an arrangement may minimise contact between the cutting arrangement and the sealing surface of the valve seat during movement of the carriage member between its first and second positions. This may minimise the risk of the valve seat sealing surface from being damaged by the cutting arrangement, particularly if the cutting arrangement is damaged or deformed due to a cutting operation, which could otherwise compromise sealing with the valve member.

The ability of the valve member to move relative to the carriage member may advantageously permit the clearance gap between the cutting path and the sealing surface of the valve seat to be provided, without compromising the ability of the valve member to sealingly engage the valve seat. That is, should the valve member be fixed relative to the carriage member, a clearance gap between the cutting path and the valve seat may also create a clearance gap between the valve member and the valve seat when the carriage member is positioned within its second position, such that sealing may not be possible. The ability of the valve member to move relative to the carriage member permits the valve member to move to close such a clearance gap and seat against the valve seat.

The ability of the valve member to move relative to the carriage member may permit the valve member to selectively sealingly engage the valve seat when the carriage member is in the second position. This may allow control of flow along the flow path while the carriage member is located within its second position. That is, the flow path may be closed and subsequently opened again without necessarily returning the carriage member to its first position. This arrangement may permit the valve member to function as a one way valve, for example. That is, a pressure differential applied in one direction across the valve member may move the valve member to engage the valve seat, whereas a pressure differential applied in an opposite direction may lift the valve member from the valve seat. Such an arrangement may permit the valve apparatus to provide a pump-through function, for example.

The valve member may comprise or define any suitable shape which facilitates sufficient and proper engagement with the valve seat. The valve member may be in the form of a plate. The valve member may comprise a curved surface, such as a spherical surface, convex surface, concave surface or the like.

The valve member may comprise a flapper valve member or plate.

The valve member may comprise a ball, or at least a portion of a ball.

The valve member may comprise a poppet.

The valve member may comprise a pin.

The connection assembly providing connection between the valve member and the carriage member may provide at least one degree of freedom of motion therebetween. The at least one degree of freedom of motion may comprise rotational motion, linear motion, motion along a curved path or any suitable combination thereof.

The connection assembly may provide multiple degrees of freedom of motion between the valve member and the carriage member.

The connection assembly may comprise a pivot connection between the carriage member and the valve member. The pivot connection may comprise or define a pivot axis. Movement of the carriage member may change the position of the pivot axis. For example, movement of the carriage member may displace the pivot axis across, for example transversely across, the flow path, for example from one side of the flow path to the other.

The connection assembly may comprise a pinned connection between the valve member and the carriage member. Such an arrangement may permit a relative rotational motion between the valve member and the carriage member The connection assembly may comprise a pinned linkage connection between the valve member and the carriage member, providing both relative rotational and linear motion therebetween.

The valve apparatus may comprise a biasing arrangement operable between the carriage member and the valve member. The biasing arrangement may bias the valve member to move relative the carriage member in one direction. In one embodiment the biasing arrangement may bias the valve member in a direction to engage the valve seat when the carriage member is located within its second position. The biasing arrangement may comprise a spring, resilient member or the like.

The valve apparatus may comprise a valve member guide arrangement operable to guide the valve member during movement of the carriage member from its first position to its second position. Such guiding of the valve member may involve guiding of the valve member into engagement with the valve seat during movement of the carriage member from its first position towards its second position.

The valve member guide arrangement may comprise a cam arrangement.

The valve member guide arrangement may comprise a track and follower arrangement.

In one embodiment the valve apparatus may comprise a track fixed relative to the housing and a follower member mounted on the valve member, wherein the follower member is received within said track. The track may define a profile or geometry which controls movement of the valve member, via the follower pin, during movement of the carriage member.

The track may be directly formed within the housing, for example formed within a internal wall surface of the housing. Alternatively, the track may be formed within an insert mountable within the housing.

In one embodiment a single track and follower arrangement may be provided. Alternatively, multiple, for example two, track and follower arrangements may be provided, for example on opposite sides of the valve member.

In some embodiments the valve member guide arrangement may be operable to drive the valve member into engagement with the valve seat upon final movement, for example rotational movement, of the carriage member from its first position to its second position.

The valve apparatus may comprise a stop arrangement for preventing or restricting movement of the carriage member beyond its first and/or second positions.

The carriage member may be rotatably mounted within the housing, such that the carriage member is rotatable to move between its first and second positions. In such an arrangement the carriage member may comprise or define a saddle. The saddle may comprise first and second side members which are connected via a lateral member. The side members may facilitate a rotatable connection relative to the housing. The lateral member may carry the cutting arrangement. The valve member may be connected to the lateral member.

The carriage member may be mounted within the housing to be moved along a linear path between its first and second positions.

The carriage member may be mounted within the housing to be moved along an arcuate path between its first and second positions.

The valve apparatus may comprise an actuator for moving the carriage member between its first and second positions. The actuator may comprise a hydraulic actuator, pneumatic actuator, mechanical actuator or the like.

The actuator may comprise a rotary actuator for rotating the carriage member. In one embodiment the rotary actuator may be mounted externally of the housing, with a rotatable drive shaft extending through a wall of the housing providing driving engagement between the actuator and the carriage member.

The rotary actuator may comprise an actuator body and a vane piston within the actuator body, and coupled to a drive structure, such as a drive shaft, wherein the actuator body and vane piston together define a piston chamber. The vane piston may be rotatable around a rotation axis to vary the volume of the piston chamber, under the action of a working fluid within the piston chamber. Such rotational motion may be transmitted to the carriage member.

The actuator body may form part of the housing of the valve. As such, the actuator may be at least partially contained within the housing. Such an arrangement may allow the valve apparatus to define a minimum envelope, which may allow the valve apparatus to fit within contained or restricted spaces.

The actuator may comprise a linear actuator for moving the carriage along a generally linear path. For example, the linear actuator may comprise one or more lead screws, linear pistons or the like.

The carriage member may comprise or be formed of a single component. Alternatively, the carriage member may comprise or be formed of multiple components.

The housing may directly define at least a portion of the flow path. For example, an inner surface of the housing may directly define at least a portion of the flow path. Alternatively, or additionally, the housing may include an insert which at least partially defines the flow path.

The housing may define or comprise one or more connectors to permit connection within a flow system. At least one connector may comprise a threaded connector. At least one connector may comprise a flange connector.

The valve seat may be fixed within the housing.

The valve seat may be moveable within the housing. The valve seat may be biased in a direction, for example a direction to engage the valve member.

The valve apparatus may comprise a second carriage member which carries a second cutting arrangement and second valve member. Such an arrangement may permit the valve apparatus to define or provide a dual barrier functionality.

The valve apparatus may be suitable for use in any number of flow control applications. The valve apparatus may be suitable for use in flow control applications associated with the exploration and production of hydrocarbons or other subterranean fluids. The valve apparatus may be suitable for use in subsea applications.

The valve apparatus may be suitable for use in in-riser applications. The valve apparatus may be suitable for use in open-water applications.

In some embodiments the valve apparatus may be for use in a landing string. For example, the valve apparatus may be for use in or define a subsea test tree (SSTT).

The valve apparatus may be for use in or define a retainer valve.

An aspect of the present invention relates to a method for controlling flow along a flow path, comprising:

providing a carriage member carrying a cutting arrangement and a valve member;

moving the carriage member from a first position towards a second position to drive the cutting arrangement across the flow path and to generally align the valve member with a valve seat; and moving the valve member relative to the carriage member to engage and/or disengage the valve seat to control flow along the flow path.

When an object is located within the flow path, movement of the cutting arrangement across the flow path may cause the object to be cut.

An aspect of the present invention relates to a valve apparatus, comprising:

a housing defining a flow path;

a valve seat located within the housing around a periphery of the flow path;

a carriage member located within the housing;

a valve member mounted on the carriage member via a connection assembly which permits relative movement between the valve member and the carriage member, wherein the carriage member is moveable from a first position towards a second position to move the valve member into a position in which relative movement between the valve member and the carriage member permits the valve member to sealingly engage and disengage the valve seat to control flow along the flow path.

An aspect of the present invention relates to a method for controlling flow along a flow path, comprising:

providing a carriage member carrying a valve member;

moving the carriage member from a first position towards a second position to generally align the valve member with a valve seat; and moving the valve member relative to the carriage member to engage and/or disengage the valve seat to control flow along the flow path.

An aspect of the present invention relates to a subsea test tree (SSTT), comprising:

a housing defining a flow path;

a valve seat located within the housing around a periphery of the flow path;

a carriage member located within the housing;

a cutting arrangement mounted on the carriage member; and a valve member mounted on the carriage member via a connection assembly which permits relative movement between the valve member and the carriage member, wherein the carriage member is moveable from a first position towards a second position to drive the cutting arrangement across the flow path and to move the valve member into a position in which relative movement between the valve member and the carriage member permits the valve member to sealingly engage and disengage the valve seat to control flow along the flow path.

The SSTT may be mountable on or form part of a landing string.

The SSTT may be locatable within a blow out preventer (BOP).

Further aspects of the present invention relate to a landing string.

Further aspects of the present invention relate to methods for performing wellbore intervention using a valve apparatus according to any other aspect.

Features defined in relation to one aspect may be applied in combination with any other aspect.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
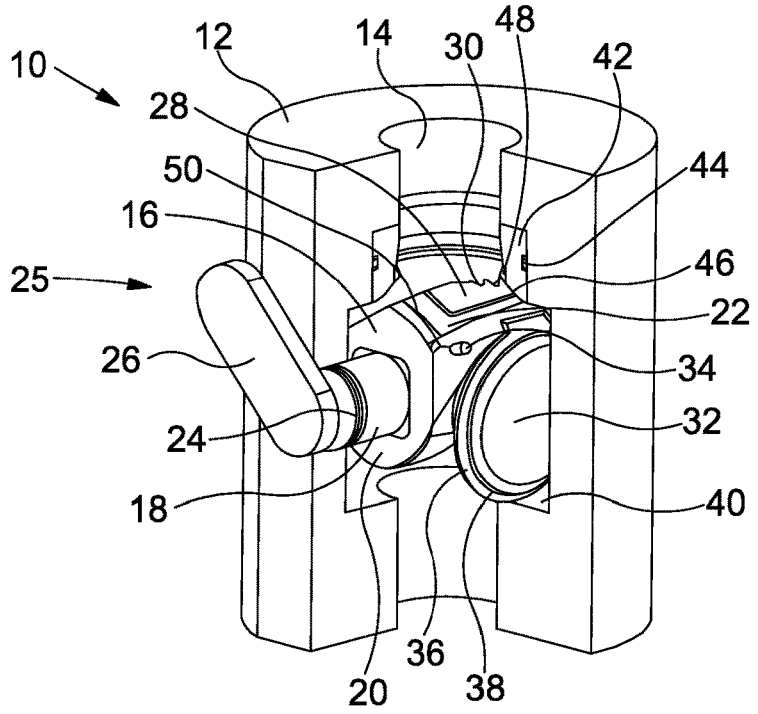
FIG. 1 is a partial sectional view of a valve apparatus in accordance with an embodiment of the present invention.

A valve apparatus, generally identified by reference numeral 10, in accordance with an embodiment of the present invention is shown in partial cross-section in FIG. 1. The apparatus 10 may be used in any valve application where flow control is required. As described in more detail below, the valve apparatus 10 may be used within a subsea test tree (SSTT).

The apparatus 10 comprises a housing 12 which defines an internal flow path 14 for facilitating flow and objects to extend therethrough. Although not illustrated, the housing 12 may include connectors, such as flange connectors, on opposing ends to permit the apparatus 10 to be coupled within a flow system (not shown). Further, although the housing 12 is illustrated in FIG. 1 as a unitary component, the housing may be formed by multiple components.

A carriage member in the form of a saddle 16 is rotatably mounted within the housing via boss or shaft members 18 (only one visible in FIG. 1). The saddle 16 is shown in a first or open position in FIG. 1. The saddle 16 includes opposing rotary plates 20 (only one visible in FIG. 1) which are connected to the respective shaft members 18, with a cross member 22 extending between the rotary plates 20. Each shaft member 18 extends through a wall of the housing 12, sealed using dynamic seals 24, and secured to an actuator assembly 25, specifically a pair of rotary actuators 26 (only one visible in FIG. 1). The rotary actuators 26 may be any suitable actuator which can apply torque to the shaft members 18, and in the present embodiment is generally illustrated as a crank arm. Such a crank arm may be operated by a piston arrangement, for example.

A cutting insert 28 which includes a profiled cutting edge 30 is mounted on the saddle 16, specifically on the cross member 22 of the saddle 16, at a leading edge thereof. As will be described in further detail below, the cutting insert 28 is operable to cut through an object located within the flow path 14 during rotation of the saddle 16 from its first position of FIG. 1, to a second or closed configuration, described later.

A valve member in the form of a flapper 32 is pivotally mounted on the saddle 16, specifically on the cross member 22, via a pivot pin 34. The flapper 32 defines a peripheral sealing face 36 which carries a sealing member 38, which in some embodiments includes a non-elastomeric sealing member. In other embodiments no sealing member may be present, or more than one may be utilised. When the saddle 16 is positioned in its first position of FIG. 1 the flapper 32 is located within a recess 40, specifically an annular recess, formed in the housing 12. Accordingly, when the saddle 16 is positioned in the illustrated first position, the flapper 32 is oriented such that the sealing face 36 is generally outwardly facing, away from the flow path 14, and also generally positioned within the annular recess 40. Thus, the sealing face 36 may be protected to assist to minimise damage from flow and/or objects passing through or along the flow path 14. Although not illustrated, in some embodiments a protection seat profile may be formed or provided within the housing against which protection seat the flapper 32 engages when in its first position.

A valve seat 42 is mounted within the housing 12, around a periphery of the flow path 14. The valve seat 42 is generally annular in form and is sealed relative to the housing 12 via a seal member such as an O-ring 44. Although not shown, the valve seat 42 may be mounted on a biasing member, such as a spring, to bias the seat member 42 in a desired direction relative to the housing 12. The valve seat 42 defines a sealing surface 46 which is arranged to cooperate with the sealing surface 36 of the flapper 32 when the saddle 16 is located in a second position, as described below. Such engagement between the sealing surfaces 36, 46 facilitates closure of the flow path 14.

A seat cutting insert 48 is mounted on the valve seat 42, and as will be described below cooperates with the cutting insert 28 of the saddle 16 to cut an object within the flow path 14.

A wiper element 50 formed of a thermoplastic material such as PEEK, for example, is mounted on the saddle 16, specifically on the cross member 22 rearwardly of the cutting insert 28. As will be described in detail below, the wiper element 50 functions to wipe the sealing surface 46 of the valve seat 42, at least in the general region of cutting an object.

Figure 2:
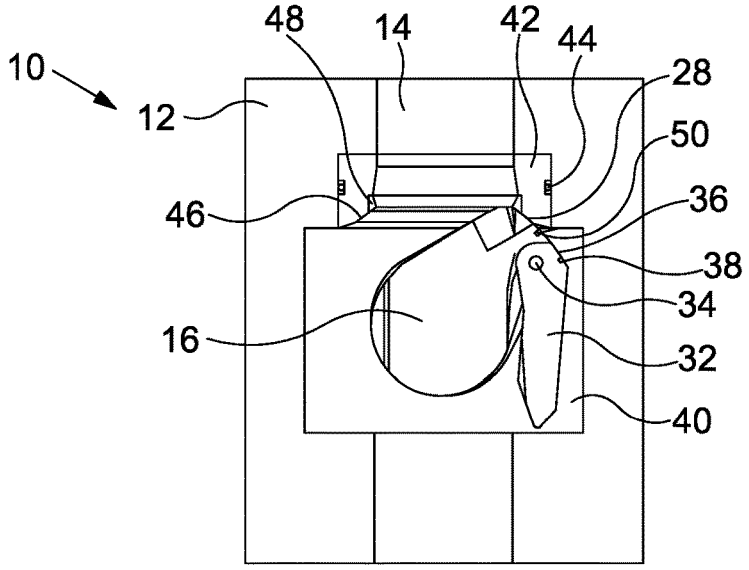
FIG. 2 is a longitudinal cross-sectional view of the valve apparatus of FIG. 1, with a carriage member shown in a fully open position.

Reference is additionally made to FIG. 2 in which a longitudinal cross-sectional view of the apparatus 10 is shown, with the saddle 16 in its first or fully open position. In this position, as noted above, the flapper 32 is located within the recess 40 and thus largely protected from flow and any objects passing along the flow path 14. Further, when in this position the flow path 14 is largely unrestricted, thus minimising any bore restrictions which might otherwise create pressure/energy losses in a flow, provide a snagging point for objects or the like.

Figure 3:
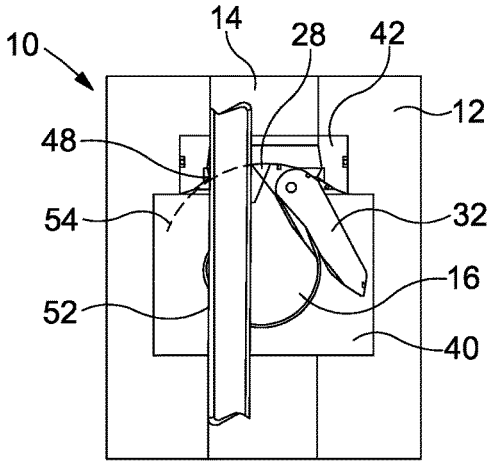
FIG. 3 is a longitudinal cross-sectional view of the valve apparatus of FIG. 1 with a cutting edge of the carriage member initially engaging a section of coiled tubing extending through the valve apparatus.
Figure 4:
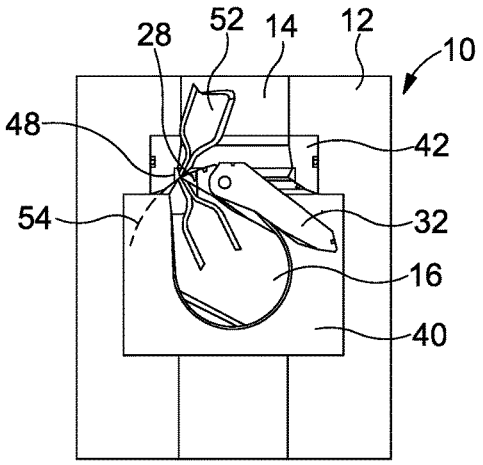
FIG. 4 is a longitudinal cross-sectional view of the valve apparatus of FIG. 1, with the cutting edge of the carriage member cutting through coiled tubing.

A closing sequence of the saddle 16 will now be described with reference to FIGS. 3 to 7. Referring first to FIG. 3, the saddle 16 is shown rotated until the cutting insert 28 engages an object, in this case coiled tubing 52, pushing the tubing 52 into engagement with the cutting insert 48 of the valve seat 42. In this respect, as the saddle 16 rotates, the cutting insert 28 is translated along a cutting path 54, illustrated in broken outline. Further rotation of the saddle 14, as illustrated in FIG. 4, crushes the tubing 52, with the cutting inserts 28, 48 establishing a shear stress in the tubing 52 largely along the direction of the cutting path 54 to cause this to be cut.

Figure 5A:
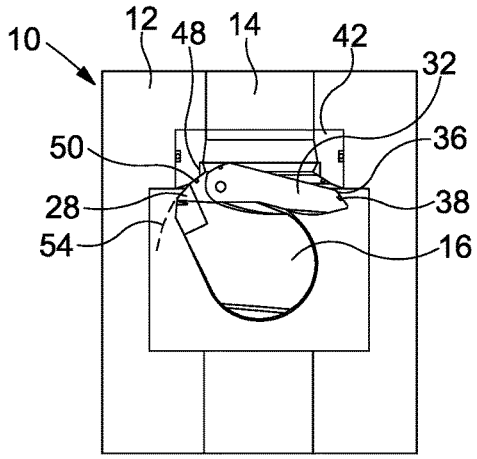
FIG. 5A is a longitudinal cross-sectional view of the valve apparatus of FIG. 1, with the carriage member approaching a fully closed position.
Figure 5B:
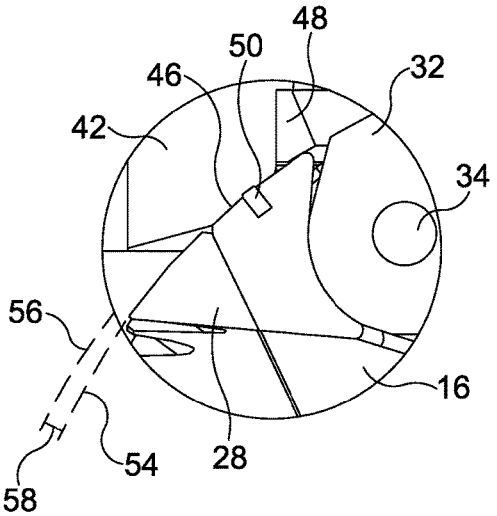
FIG. 5B is an enlarged view of FIG. 5A in the region of the carriage member, showing a wiper component wiping a valve seat sealing surface during movement of the carriage member towards its closed position.

Once the tubing 52 is cut the saddle 16 continues to rotate and move the cutting insert 28 along the cutting path 54, as illustrated in FIG. 5A (the tubing 52 has been removed for clarity in FIG. 5A), with the lower cut tubing being pushed into the recess 40, thus minimising interference with the valve member 32. An enlarged view in the region of the cutting insert 28 is provided in FIG. 5B, reference to which is additionally made, and illustrates, in broken outline, a sealing plane 56 of the sealing surface 46 or the valve seat 42. A clearance gap 58 is provided between the cutting path 54 and the sealing plane 56. It should be noted that the clearance gap has been exaggerated in FIG. 5A for illustration purposes.

Figure 5C:
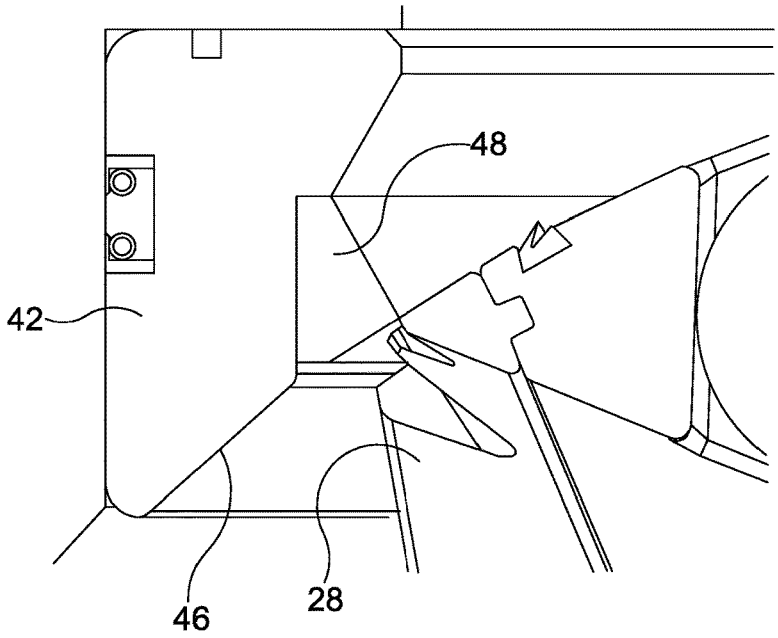
FIG. 5C provides an enlarged view of the valve assembly 10 of FIG. 1 in the region of a cutting insert on the carriage member, shown at the point of initial alignment with a cutting insert of the valve seat.
Figure 5D:
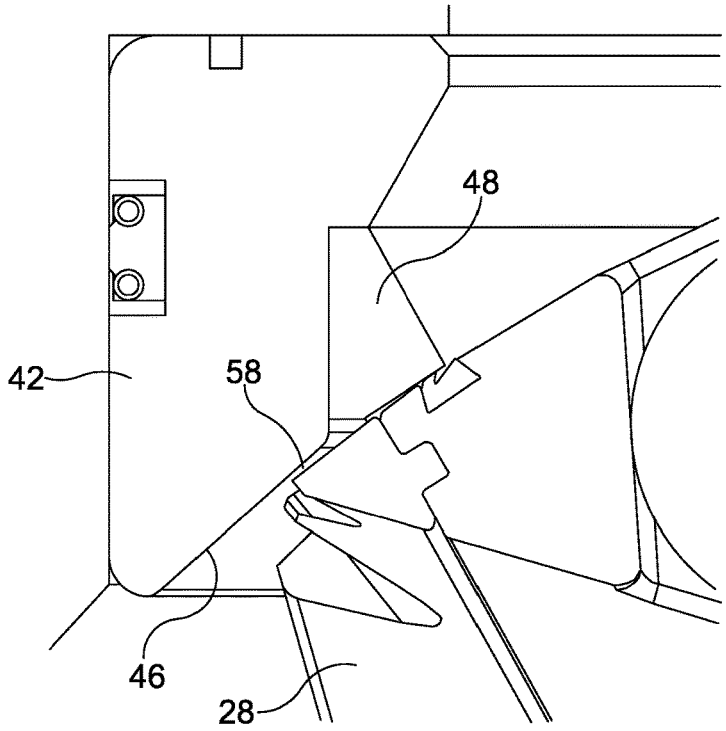
FIG. 5D provides a further enlarged view in the region of the cutting insert during alignment with a sealing surface of the valve seat.

The feature of the clearance gap 58 is further illustrated with reference to FIGS. 5C and 5D. FIG. 5C provides an enlarged view in the region of the cutting insert 28, shown at the point of initial alignment with the cutting insert 48 of the valve seat 42. In this arrangement a very close relationship is achieved between the respective inserts 28, 48. FIG. 5D provides an enlarged view in the region of the cutting insert 28 during alignment with the sealing surface 46 of the valve seat 42. In this respect a separation is present between the cutting insert 28 and the sealing surface 46, which provides the clearance gap 58.

The provision of this clearance gap 58 minimises the risk of the cutting insert 28, which may have been damaged/deformed during cutting, from scoring the sealing surface 46 of the valve seat 42, which may otherwise prevent a full seal with the valve member 32 from being achieved.

Referring again to FIG. 5B, as the saddle 16 rotates, the wiper element 50 functions to wipe the sealing surface 46 of the valve seat, removing particles and other contaminates, preparing the surface 46 for a robust sealing engagement with the flapper 32.

Figure 6A:
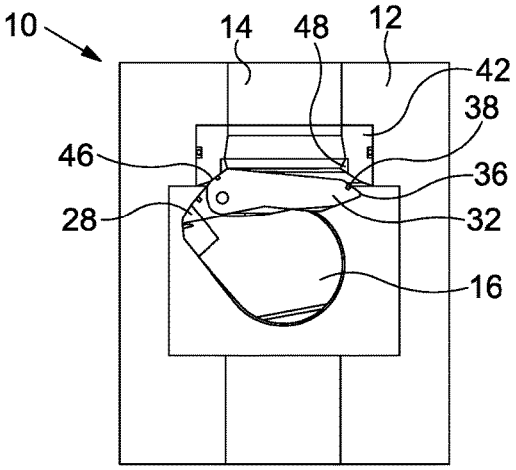
FIG. 6A is a longitudinal cross-sectional view of the valve apparatus of FIG. 1 with the carriage member in a closed position, and with a valve member mounted on the carriage shown disengaged from a valve seat.
Figure 6B:
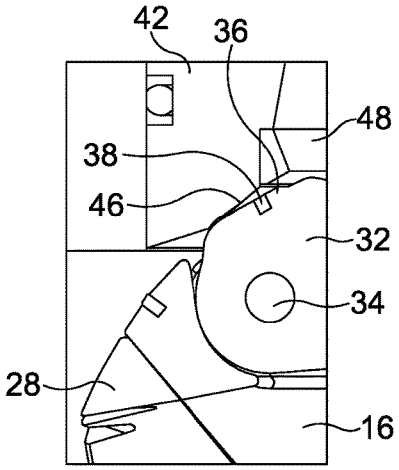
FIG. 6B is an enlarged view of FIG. 6A in the a region of the valve member and the valve seat.

Complete rotation of the saddle 16 to a second position is illustrated in FIG. 6A. Although not shown, the apparatus 10 includes an end stop which prevents the saddle 16 from rotating beyond this second position, ensuring proper alignment of the valve member 32. In the configuration shown in FIG. 6A the flapper 32 is shown positioned relative to the saddle 16 such that sealing engagement with the valve seat 42 is not yet achieved, still permitting flow along the flow path 14. An enlarged view in the region of the pivoting side of the flapper 32 is shown in FIG. 6B, which illustrates the presence of clearance between the sealing surface 36 of the flapper 32 and the sealing surface 46 of the valve seat 42.

Figure 7A:
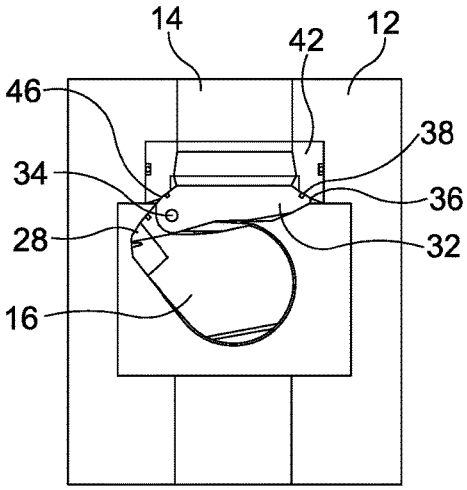
FIG. 7A is a longitudinal cross-sectional view of the valve apparatus of FIG. 1 with the carriage member in a closed position, and with the valve member engaged with the valve seat.

FIG. 7A illustrates the flapper 32 fully pivoted about its pivot pin 34 such that the sealing surface 36 of the flapper 32 is engaged with the sealing surface 46 of the valve seat 42, thus preventing flow along the flow path 14. In the present embodiment the flapper 32 is passively mounted on the saddle 16, and as such is caused to pivot about its pivot pin 34 to provide sealing with the valve seat 42 by action of fluid flow and/or pressure within the flow path 14. For example, where the fluid pressure below the flapper 32 exceeds the pressure above, the flapper 32 will be moved and held in its closed position. Conversely, where the pressure above the flapper 32 exceeds the pressure below, the flapper 32 will be lifted from the valve seat 42, again allowing flow along the flow path. Such an arrangement permits the apparatus 10 to provide a pump-through capability, without altering the position of the saddle 16.

Figure 7B:
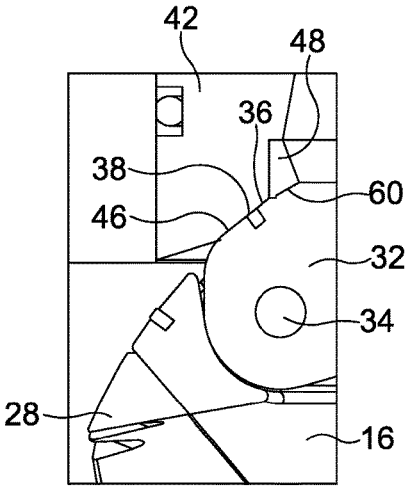
FIG. 7B is an enlarged view of FIG. 6A in the a region of the valve member and the valve seat.

FIG. 7B is an enlarged view of the closed apparatus 10 in the region of the pivoting side of the flapper 32, illustrating the sealing engagement of the respective sealing faces 36, 46, and the sealing member 38. As most clearly illustrated in FIG. 7B, the flapper 32 includes a recessed region 60 which accommodates the cutting insert 48 on the valve seat 42 when the flapper 32 is closed.

Figure 8A:
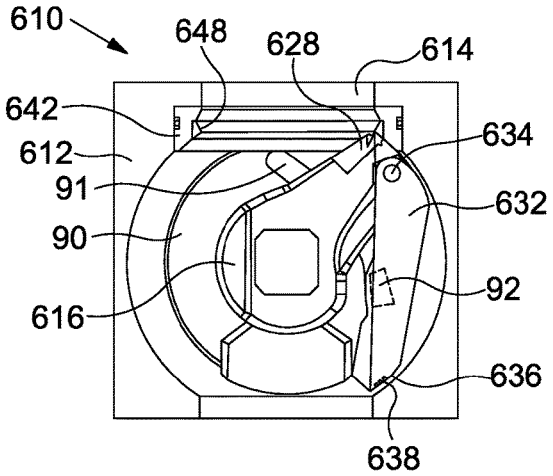
FIGS. 8A, 8B and 8C provide various views of a valve apparatus in accordance with an alternative embodiment of the present invention.

An enlarged sectional view of a portion of a valve apparatus, generally identified by reference numeral 610, in accordance with an alternative embodiment of the present invention will now be described with reference to FIGS. 8A, 8B and 8C. The valve apparatus 610 is similar to the apparatus 10 first shown in FIG. 1 in both structure and operation, and as such like features share like reference numerals, incremented by 600. Referring initially to FIG. 8A, the apparatus 610 is shown in an open position and includes a housing 612 defining a flow path 614, with a saddle 616 rotatably mounted in the housing 612. The saddle 616 carries a cutting insert 628 which, in use, cooperates with a cutting insert 648 in a valve seat 642 to cut an object within the flow path 614. A flapper 632 is pivotally mounted on the saddle 616 via pivot pin 634, wherein the flapper 632 includes a sealing surface 636 and sealing members 638.

In the present embodiment the flapper 632 is operatively connected relative to the housing 612 via a track and follower arrangement. In this respect, the valve apparatus 610 includes a housing insert 90 which includes a track 91, and the flapper 632 includes a follower 92 (shown in broken outline in FIG. 8A) which is received within the track 91. FIG. 8B provides a perspective view of the housing insert 90 and flapper 632, in isolation, which illustrates the follower 92 received within the slot 91. Further, FIG. 8B illustrates a second follower 92*a* on an opposing side of the flapper 632 which is engaged with a respective opposing slot (not shown).

Figure 8C:
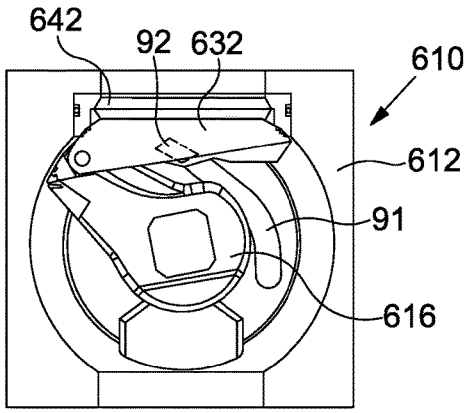
Figure 8B:
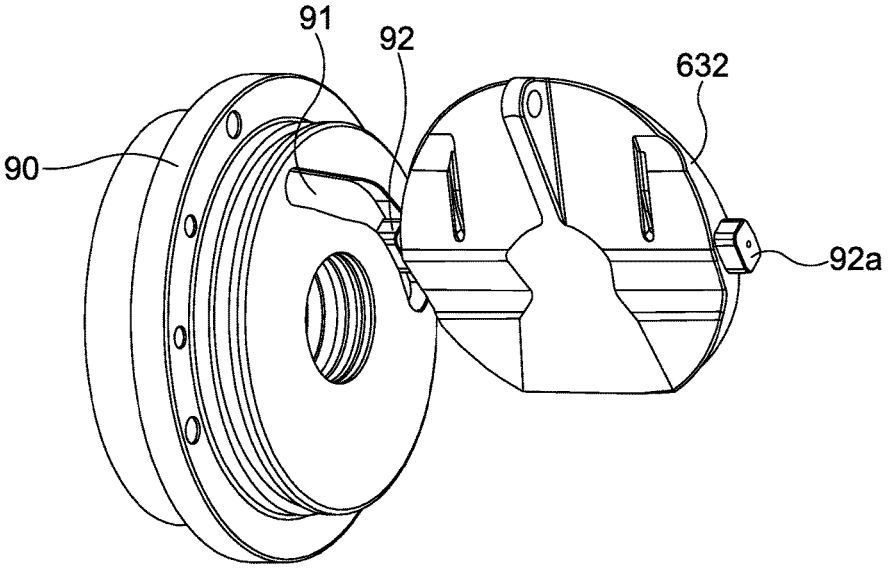

During rotation of the saddle 616 the pivoting movement of the flapper 632 relative to the saddle 616 is controlled by the profile of the track 91, and as illustrated in FIG. 8C, when the saddle 616 is fully rotated the flapper 632 is pivoted relative to the saddle 616 to engage the flapper 632 with the valve seat 642.

Figure 9:
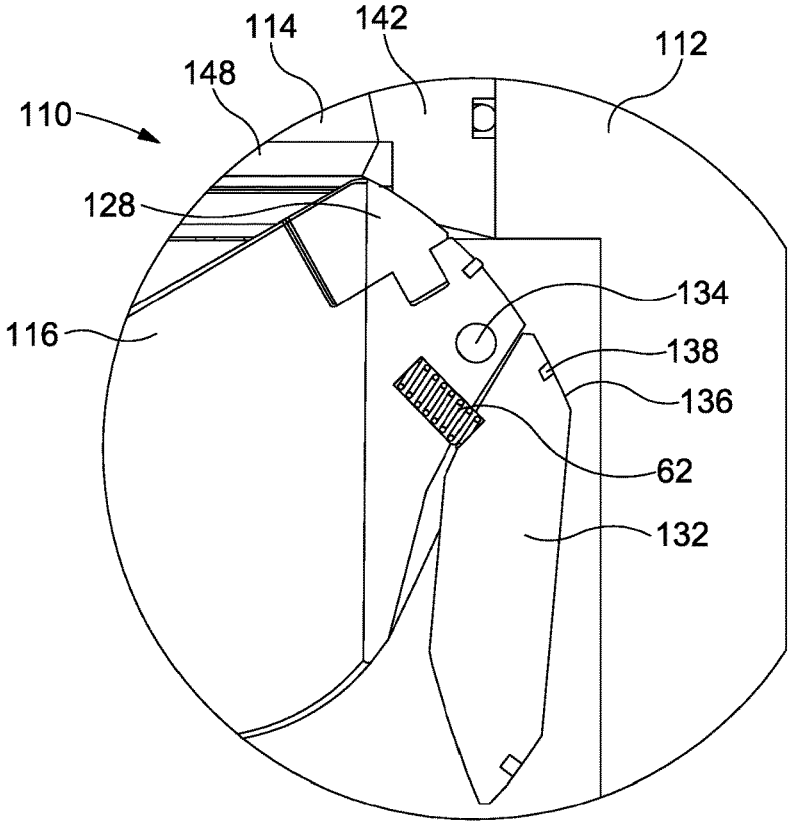
FIG. 9 is an enlarged view of a carriage member and valve member of a valve apparatus in accordance with an alternative embodiment of the present invention.

An enlarged sectional view of a portion of a valve apparatus, generally identified by reference numeral 110, in accordance with an alternative embodiment of the present invention is shown in FIG. 9. The valve apparatus 110 of FIG. 9 is similar to the apparatus 10 first shown in FIG. 1 in both structure and operation, and as such like features share like reference numerals, incremented by 100. Thus, the apparatus 110 includes a housing 112 defining a flow path 114, with a saddle 116 rotatably mounted in the housing 112. The saddle 116 carries a cutting insert 128 which, in use, cooperates with a cutting insert 148 in a valve seat 142 to cut an object within the flow path 114. A flapper 132 is pivotally mounted on the saddle 116 via pivot pin 134, wherein the flapper includes a sealing surface 136 and sealing member 138. In the present embodiment the flapper 132 is actively mounted on the saddle by the presence of a biasing arrangement in the form of a spring 62 which biases the flapper 132 to pivot outwardly relative to the saddle 116. Accordingly, when the saddle 116 is rotated into a second position, in a similar manner to saddle 16 of the first described embodiment, the flapper 132 may be positively moved by the spring 62 to engage the sealing surface 136 of the flapper 132 with the valve seat 142.

Although the spring 62 provides, to a certain degree, an active operation of the flapper 132, a pump through capability is still present by application of a positive pressure differential from above the flapper 132. In such a case the pressure applied above the flapper 132 would need to be larger than the pressure below, and be sufficient to exceed the extra closing force applied by the spring 62.

Figure 10:
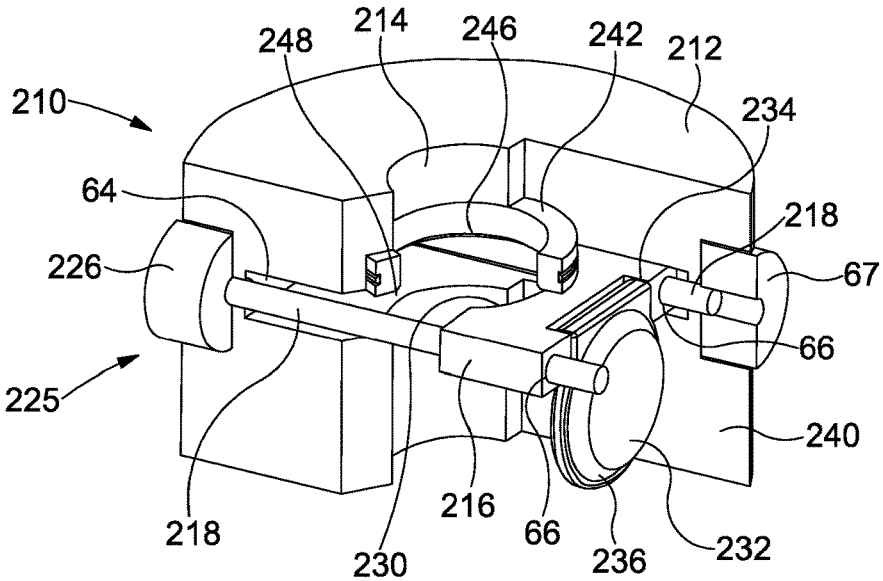
FIG. 10 is a partial sectional view of a valve apparatus in accordance with another embodiment of the present invention.

A partial cross-sectional view of a valve apparatus, generally identified by reference numeral 210, in accordance with an alternative embodiment of the present invention is shown in FIG. 10. The valve apparatus 210 of FIG. 10 is largely similar to the apparatus 10 first shown in FIG. 1 and as such like features share like reference numerals incremented by 200.

The apparatus 210 includes a housing 212 defining a flow path 214 and accommodates a carriage member in the form of a gate 216 which is arranged to move linearly within a pocket 64 formed in the housing 212. The gate 216 defines a cutting edge 230 which may be directly formed on the gate 216 or alternatively provided via an insert. A flapper 232 is pivotally mounted on the gate 216 via pivot connection 234, wherein the flapper 232 includes a peripheral sealing surface 236. A valve seat 242 is mounted in the housing 212, wherein the seat 242 defines a sealing surface 246 and a cutting region 248, which may be provided via a separate insert. As will be described below, in use sealing surface 246 cooperates with the sealing surface 236 of the flapper 232 to establish a seal therebetween, and the cutting edge 230 of the gate 216 cooperates with the cutting region 248 of the seat 242 to cut any object within the flow path 214.

The gate 216 is illustrated in FIG. 10 being located within a first position, in which the flow path 214 is completely open, with the flapper 232 being located within a recess 240. As in the apparatus 10 of FIG. 1, when the flapper 232 is positioned within the recess 240 said flapper 232 may be appropriately protected, minimising damage from flow and/or objects passing along the flow path 214.

The apparatus 210 further comprises an actuator arrangement 225 which includes a pair of lead-screws 218 which threadedly cooperate with threaded bores 66 on either side of the gate 216. One end of each lead-screw 218 is connected to a bush member 67, and an opposite end of each lead-screw 218 is connected to a rotary actuator 226. The actuators 226 operate to rotate the lead-screws and drive the gate 216 linearly within the pocket 64 across the flow path 214.

Figure 11:
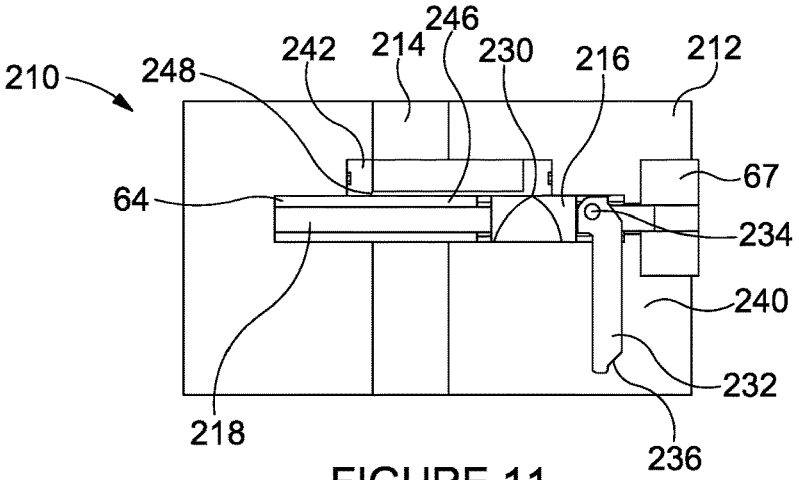
FIGS. 11, 12 and 13 are cross sectional diagrammatic illustrations of the valve apparatus of FIG. 10, showing stages in a closing operation.

A closing sequence of the valve apparatus 210 will now be described with reference to FIGS. 11 to 13. The apparatus 210 is shown in a fully open position in FIG. 11, with the gate 216 located in a first position and the flapper 232 located within the pocket 240.

Figure 12:
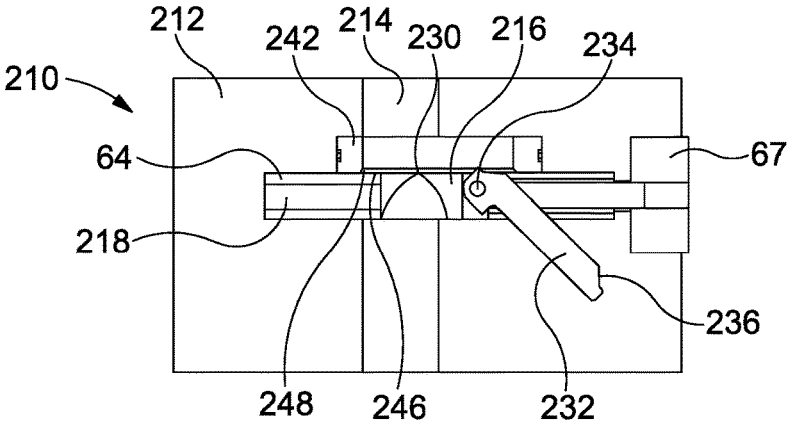

The gate 216 is then translated to move across the flow path 214 by operation of the lead-screws 218, as illustrated in FIG. 12. Any object which may be positioned within the flow path 214 will be cut by action of the respective cutting edges 230, 248. As the gate 216 is moved the flapper 232 is caused to pivot upwardly, for example by action of a camming arrangement and/or engagement with a portion of the housing 212.

Figure 13:
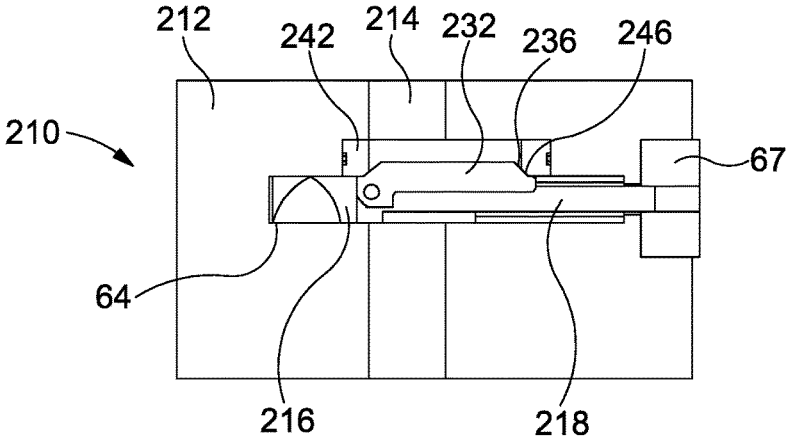

As illustrated in FIG. 13, when the gate 216 is fully moved to a second position, the flapper 232 is positioned such that pivoting motion relative to gate 216 permits the sealing surface 236 of the flapper 232 to engage the sealing surface 246 of the valve seat 242, thus sealing the flow path 214. As in the apparatus 10 first shown in FIG. 1, the flapper 232 may facilitate a pump through capability.

Figure 14:
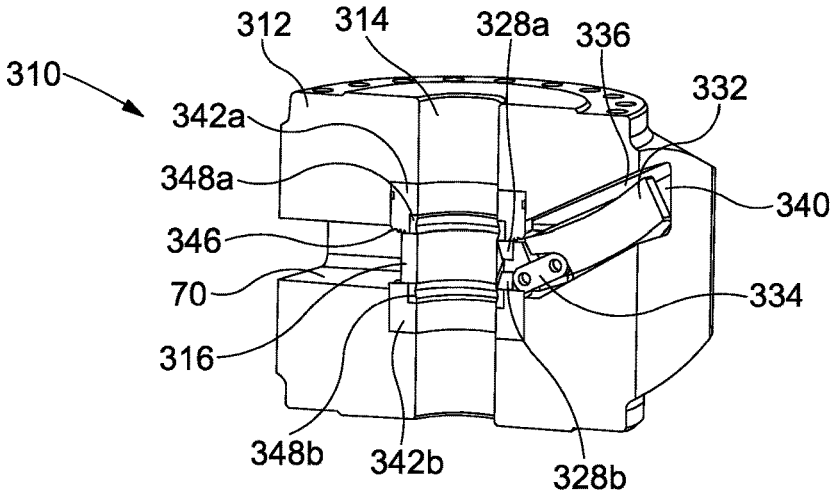
FIG. 14 is a sectional view of a valve apparatus in accordance with another embodiment of the present invention, with the valve apparatus shown in an open configuration.

FIG. 14 provides a cross-sectional illustration of a valve apparatus, generally identified by reference numeral 310, in accordance with a further alternative embodiment of the present invention. The apparatus 310 is similar in many respects to the apparatus 10 first shown in FIG. 1, and as such like features share like reference numerals, incremented by 300.

The apparatus 310 includes a housing 312 defining a flow path 314 and accommodates a carriage member in the form of a gate 316 which is arranged to move linearly within a pocket 70 formed in the housing 312. The gate 316 carries a first or upper cutting insert 328*a*, and a second or lower cutting insert 328*b*. A flapper 332 is moveably mounted on the gate 316 via a pinned link arm connection 334, wherein the flapper 232 includes a peripheral sealing surface 336 which is generally concave in profile. A first or upper valve seat 342*a* is mounted in the housing 312, wherein the first seat 342*a* defines a sealing surface 346 for sealing engagement with the sealing surface 336 of the flapper 316.

The upper valve seat 342*a* includes a first or upper cutting insert 348*a* which, in use, cooperates with the upper cutting insert 328*a* of the gate 316 to cut any object within the flow path 214. The apparatus 310 further includes a second or lower non-sealing valve seat 342*a* mounted in the housing 312 which includes a second or lower cutting insert 348*b* which, in use, cooperates with the lower cutting insert 328*b* of the gate 316 to cut any object within the flow path 314. During use, the upper and lower respective cutting inserts 328*a*, 328*b*, 348*a*, 348*b* will function to cut a slug from an object located within the flow path 314.

The gate 316 is illustrated in FIG. 14 being located within a first position, in which the flow path 314 is completely open, with the flapper 332 being located within a recess 340. As in the apparatus 10 of FIG. 1, when the flapper 332 is positioned within the recess 340 said flapper 332 may be appropriately protected, minimising damage from flow and/or objects passing along the flow path 314.

Figure 15:
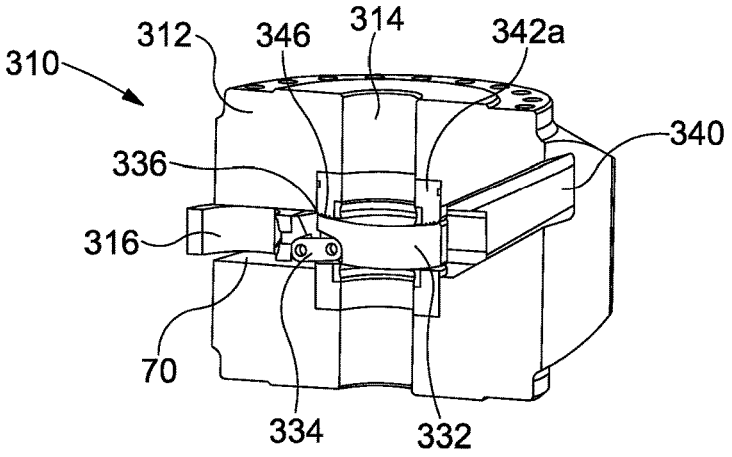
FIG. 15 is a sectional view of the valve apparatus of FIG. 14, shown in a closed configuration.

FIG. 15 illustrates the apparatus 310 in a fully closed position, with the gate 316 fully drawn across the flow path 314, aligning the flapper 332 with the upper valve seat 342 to permit sealing engagement between the respective sealing surfaces 336, 246.

Figure 16:
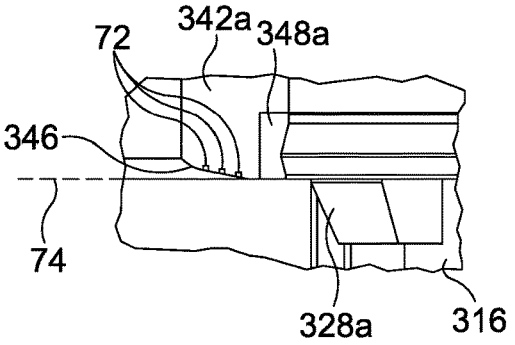
FIG. 16 is an enlarged view of a cutting arrangement of the valve apparatus of FIG. 14.

An enlarged view in the region of the upper valve seat 342*a* is provided in FIG. 16, with the gate 316 in a position in which the upper cutting insert 328*a* is approaching the upper cutting insert 348*a* of the upper valve seat 342*a*. The sealing surface 346 of the upper valve seat 342*a* includes a plurality (three in the embodiment shown) of sealing members 72, such as non-elastomeric sealing members. Further, the cutting plane 74 (shown in broken outline) defined by movement of the gate 316 is such that clearance with the sealing surface 346 is provided, thus minimising the risk of the upper cutting insert 328*a* of the gate 316 from damaging the sealing surface 346, or its associated sealing members 72.

Figure 17:
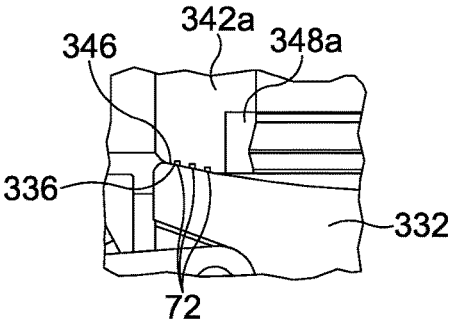
FIG. 17 is an enlarged view of a sealing arrangement of the valve apparatus of FIG. 14.

FIG. 17 provides an enlarged view in the region of the upper valve seat 342*a*, with the flapper 332 sealingly engaged with the upper valve seat 342*a*.

Figure 18:
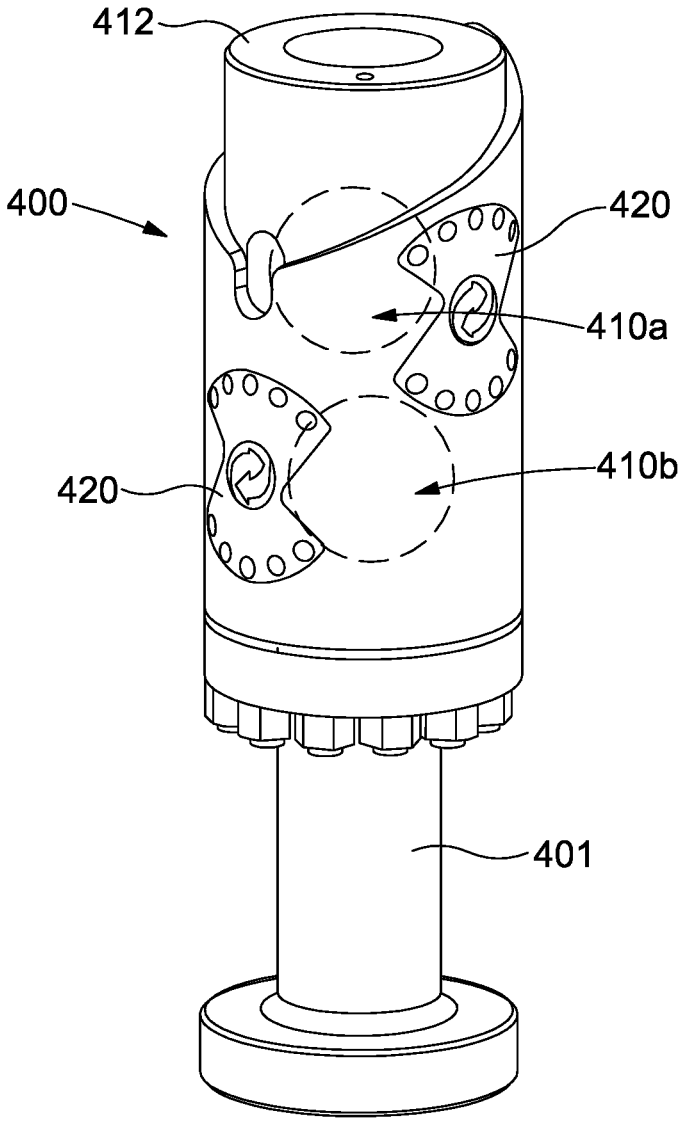
FIG. 18 is a perspective view of a subsea test tree (SSTT) in accordance with an embodiment of the present invention.

Embodiments of the present invention may be used in any suitable flow control application. In one exemplary use, embodiments of a valve apparatus of the present invention may be used within or as part of a subsea test tree (SSTT) 400, as illustrated in FIG. 18. The SSTT 400 includes a first or upper valve apparatus 410*a* (shown in broken outline) and a second or lower valve apparatus 410*b* (also shown in broken outline). Each valve apparatus 410*a*, 410*b* may be provided in accordance with any valve apparatus described herein, such as valve apparatus 10 first shown in FIG. 1, and as such no further description will be provided, except to say that a housing 412 of the SSTT 400 defines a common housing of both valve apparatus 410*a*, 410*b*. The SSTT 400 is shown in FIG. 18 connected to a slick joint 401 via a flange connector 402.

Each valve apparatus 410*a*, 410*b* is operated by respective rotary actuators 420. In some embodiments, a pair of diametrically opposed rotary actuators 420 may be provided for each valve apparatus 410*a*, 410*b*.

Figure 19:
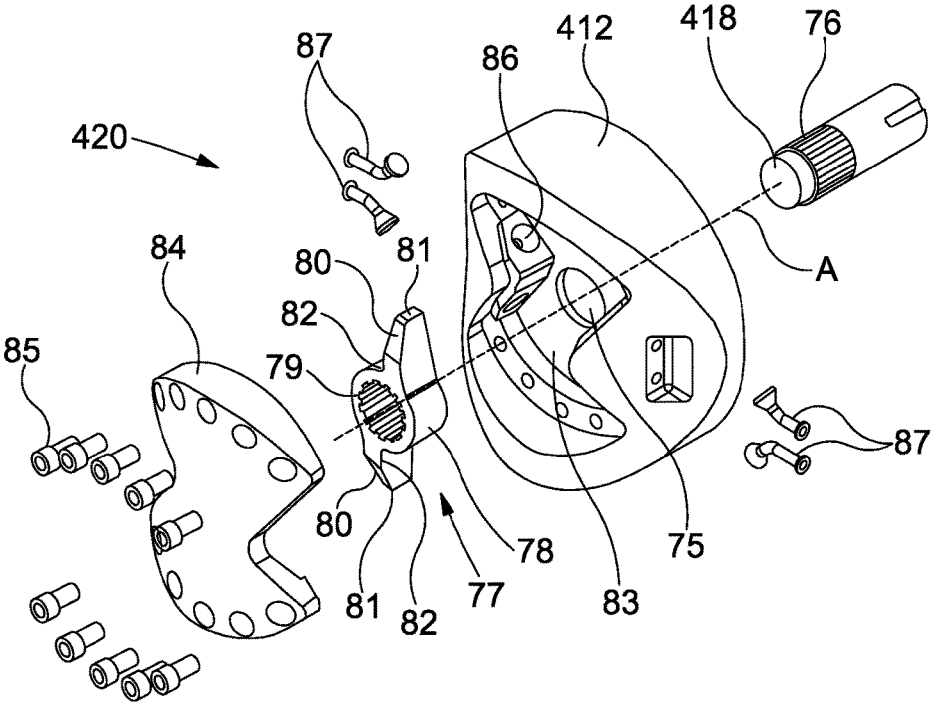
FIG. 19 is an exploded view of a rotary actuator for use in operating a valve apparatus.

FIG. 19 shows an exploded view of an actuator 420. The actuator 420 includes an actuator body defined by the housing 412 of the SSTT 400. A drive shaft 418 which is connected to a rotary carriage member such as a saddle (not shown) extends through an aperture 75 in the housing 412 and is coupled, via a spline portion 76, to a vane piston 77. The vane piston 77 includes a hub 78, having splines 79 around an inside of an aperture through the hub 78, to enable the vane piston 77 to be coupled to the spline portion 76 of the drive shaft 418.

The vane piston 77 also includes vanes 80, extending from diametrically opposite sides of the hub 78. The vanes 80 taper from tips 81 to a root portion 82. Each vane 80 is both wider (around the rotation axis A) and thicker (along the rotation axis A) at the root 82 than at the tip 81. The increased width of each vane 80, such that the vane 80 is general trigonal as viewed along the rotation axis A, improves the mechanical strength of the vane piston 77.

The actuator body defines a cavity 83 sized to receive the vane piston 77. An actuator cover 84 is bolted (by bolts 85) over the cavity 83, so that the actuator cover and the actuator body together define an internal chamber. In use, the vane piston 77 is operable to rotate around the axis A within the internal chamber, as described below.

Fluid passages 86 extend through the housing 412 to the cavity 83 (and thus the internal chamber). The actuator 420 is also provided with a fluid control arrangement, for regulating the flow of hydraulic fluid to/from the internal chamber. Fluid flow conduits 87, which extend to the fluid control arrangement facilitate fluid transfer relative to the internal chamber.

Figure 20:
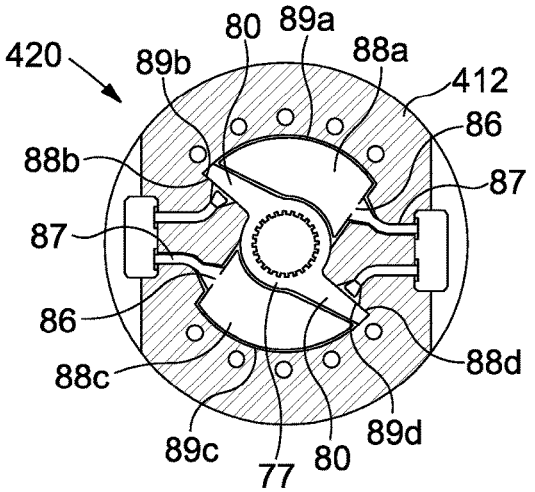
FIGS. 20 and 21 illustrate the rotary actuator of FIG. 19 in different actuation configurations.

An assembled and sectional view of the actuator 420 is shown in FIG. 20. The internal chamber is divided by the vane piston 77 into four piston chambers 88*a-d*. In the configuration shown in FIG. 20 chambers 88*a* and 88*c* are shown fully expanded, and chambers 88*b* and 88*d* are shown fully closed. Each piston chamber 88*a-d* is defined in part by the housing 412, by the vane piston 77 and by the actuator cover 84 (FIG. 19). Each piston chamber 88*a-d* communicates with a fluid passage 86, through which the flow of working hydraulic fluid is controlled via conduits 87 connected to the fluid control arrangement.

The actuator 420 is provided with inflatable bladders 89*a-d* disposed within each piston chamber 88*a-d*. In the configuration shown in FIG. 20 bladders 89*a* and 89*c* are shown fully inflated, and bladders 89*b*, 89*d* are fully deflated. The insides of the bladders 89*a-d* communicate with the passages and conduits 86, 87. Accordingly, the piston chambers 88*a-d* themselves are required only to contain the bladders 89*a-d*, and not to seal against a pressure differential, providing significant advantages. Moreover, the various internal surfaces of the actuator are not directly exposed to the working fluid.

Figure 21:
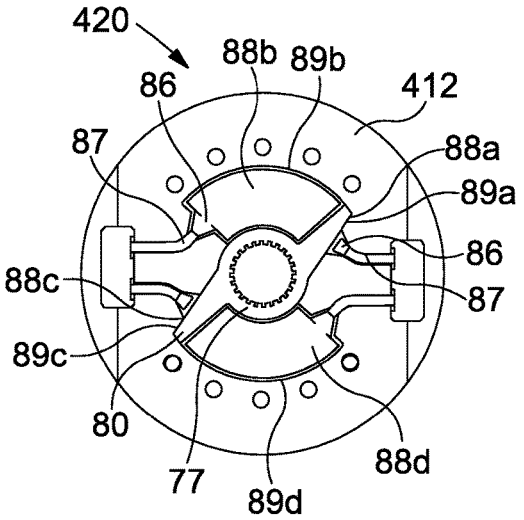

The vane piston 77 is shown in FIG. 20 in a fully stroked position in the anti-clockwise direction. In order to move the vane piston 77 clockwise, as illustrated in FIG. 21 and reconfigure the associated valve apparatus, high pressure working fluid is caused to enter the bladders 89*b* and 89*d* in the piston chambers 88*b* and 88*d*, respectively, with fluid vented from the bladders 89*a* and 89*c* in respective piston chambers 88*a* and 88*c*.

The actuator 420 is provided with a vane piston 77 having diametrically opposed vanes 80. This ensures that the forces applied around the rotation axis are equal; i.e. that only rotational forces are applied to the drive shaft 418, and there is no net force applied normal to the rotation axis A. This arrangement mitigates against binding between the drive shaft and the housing 412.

Figure 22:
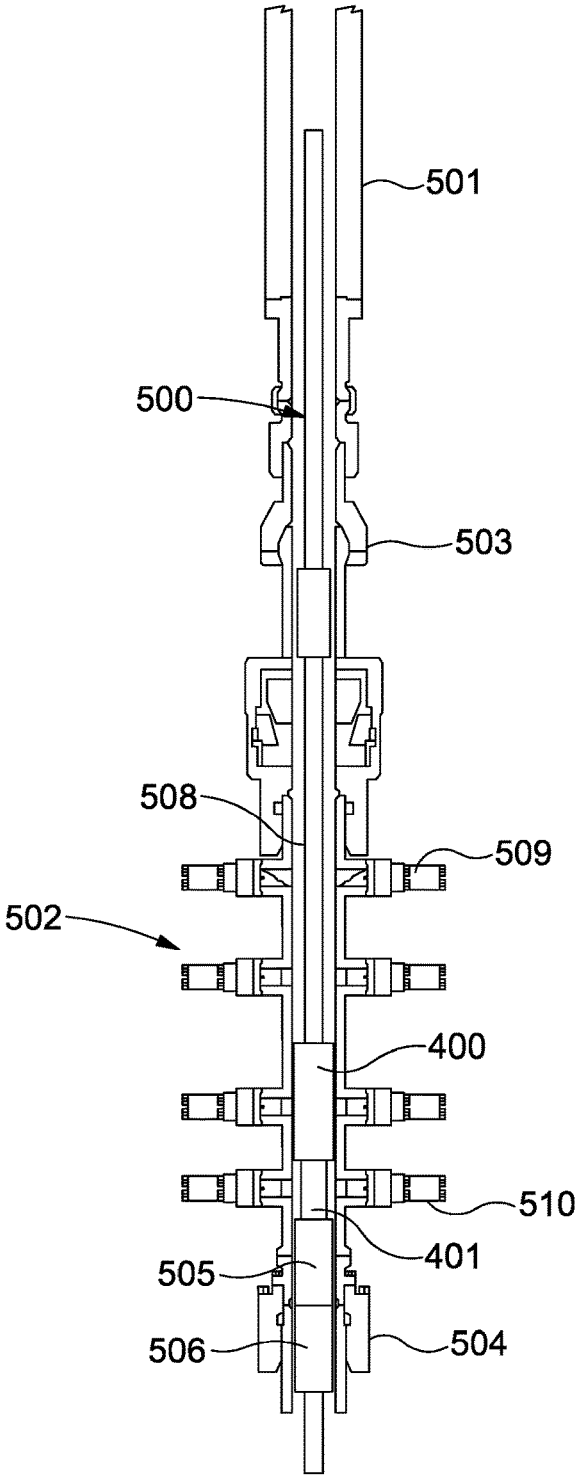
FIG. 22 is a diagrammatic illustration of a landing string in accordance with an embodiment of the present invention, wherein the landing string is shown in use within a riser and BOP.

An exemplary use of the SSTT 400 is diagrammatically illustrated in FIG. 22, which provides the SSTT 400 and slick joint 401 as part of a landing string 500. The landing string 500 may be used in multiple applications, such as in supporting wellbore intervention operations.

The landing string 500 is deployed through a marine riser 501 which is coupled to a blow-out preventer (BOP) 502 via a flex joint 503, wherein the BOP 502 is mounted on a wellhead 504. A flow path extends through the riser 501, the landing string 500 and its component parts, and in use provides access to a well for fluids, tools (run on wireline or tubing) or other apparatus/materials as required in an intervention.

The SSTT 400 sits in the landing string 500 above a tubing hanger 505, which is adapted to couple the landing string to the wellhead 504. A tubing hanger running tool 506 may also be provided to run the landing string to the wellhead 504 through the marine riser 501 and couple the tubing hanger 505 to the wellhead 504, as shown in FIG. 22.

The slick joint 401 is aligned with lower pipe rams 510 of the BOP 502 which may be closed against the slick joint 401 to form a seal in case of emergency.

In addition to the double barrier system within the SSTT 400, further valves may also be provided which sit above the BOP 502 when the landing string has been deployed, such as a retainer valve 507. The retainer valve 507 may be provided by a valve apparatus in accordance with an embodiment of the present invention.

The landing string 500 further includes a shear joint 508 which is aligned with shear rams 509 of the BOP 502.

All of the components of the landing string 500 are constrained to fit within the diameter of the riser 501. The components below the shear joint 508 must also fit within the BOP 502.

It should be understood that the embodiments described herein are merely exemplary and that various modifications may be made thereto without departing from the scope of the invention.

The invention claimed is:

1. A valve apparatus, comprising:

a housing defining a flow path;

a valve seat located within the housing around a periphery of the flow path;

a carriage member located within the housing;

a shearing cutting arrangement mounted on the carriage member; and a valve member mounted on the carriage member via a connection assembly which permits relative movement between the valve member and the carriage member, wherein the carriage member is moveable from a first position towards a second position to drive the shearing cutting arrangement along a shearing cutting plane across the flow path and shear through an object located within the flow path, and to move the valve member into a position in which relative movement between the valve member and the carriage member permits the valve member to sealingly engage and disengage the valve seat to control flow along the flow path.

2. The valve apparatus of claim 1, comprising a pocket for receiving or accommodating the valve member when the carriage member is located within its first position.

3. The valve apparatus of claim 1, comprising a valve seat cutting arrangement which cooperates with the shearing cutting arrangement mounted on the carriage member to establish a transverse shear stress in an object located within the flow path during movement of the carriage member from its first position towards its second position.

4. The valve apparatus of claim 3, wherein the valve seat cutting arrangement and the shearing cutting arrangement mounted on the carriage member are spatially arranged relative to each other to define a shear plane or plane of cut.

5. The valve apparatus according to claim 1, comprising a cutting pocket for receiving at least a portion of a cut object.

6. The valve apparatus according to claim 1, wherein the valve member comprises a valve member sealing arrangement for sealing engagement with the valve seat, the valve member sealing arrangement including one or more seal members mounted on or within a sealing surface of the valve member.

7. The valve apparatus according to claim 6, wherein when the carriage member is located within a first position the valve member is positioned such that the sealing surface of the valve member is at least partially isolated from the flow path.

8. The valve apparatus according to claim 1, wherein the valve seat comprises a seat sealing arrangement for sealing engagement with the valve member, the seat sealing arrangement including one or more seal members, wherein at least one seal member is mounted on or within a sealing surface of the valve seat.

9. The valve apparatus according to claim 1, comprising a wiper arrangement for use in wiping one or both of the valve seat and the valve member during movement of the carriage member between first and second positions.

10. The valve apparatus according to claim 9, wherein a valve seat wiper arrangement is mounted on the carriage member for wiping a sealing surface of the valve seat during movement of the carriage member.

11. The valve apparatus according to claim 10, wherein the valve seat wiper establishes compressive interference engagement with the sealing surface of the valve member.

12. The valve apparatus according to claim 1, wherein the shearing cutting arrangement is moved along a cutting path during movement of the carriage member between its first and second positions, wherein a clearance gap is provided between the cutting path of the shearing cutting arrangement and a sealing surface of the valve seat.

13. The valve apparatus according to claim 1, wherein, when the carriage member is in its second position, the valve member is moveable to engage the valve seat when a pressure differential is applied in a first direction, and is moveable to disengage the valve seat when a pressure differential is applied in a second direction, wherein the second direction is opposite the first direction.

14. The valve apparatus according to claim 1, wherein the valve member comprises at least one of a flapper, a ball, a portion of a ball, a poppet and a pin.

15. The valve apparatus according to claim 1, wherein the connection assembly providing connection between the valve member and the carriage member provides at least one degree of freedom of motion therebetween, wherein the at least one degree of freedom of motion comprises one or more of rotational motion, linear motion and motion along a curved path.

16. The valve apparatus according to claim 1, wherein the connection assembly comprises a pivot connection between the carriage member and the valve member.

17. The valve apparatus according to claim 1, comprising a biasing arrangement operable between the carriage member and the valve member, wherein the biasing arrangement biases the valve member to move relative the carriage member in one direction.

18. The valve apparatus according to claim 17, wherein the biasing arrangement biases the valve member in a direction to engage the valve seat when the carriage member is located within its second position.

19. The valve apparatus according to claim 1, comprising a valve member guide arrangement operable to guide the valve member during movement of the carriage member from its-a first position to its-e second position.

20. The valve apparatus according to claim 19, wherein the valve member guide arrangement comprises a track and follower arrangement.

21. The valve apparatus according to claim 1, comprising a track fixed relative to the housing and a follower member mounted on the valve member, wherein the follower member is received within said track such that movement of the valve member is controlled during movement of the carriage member.

22. The valve apparatus according to claim 1, comprising a stop arrangement for preventing or restricting movement of the carriage member beyond first and/or second positions.

23. The valve apparatus according to claim 1, wherein the carriage member is rotatably mounted within the housing, such that the carriage member is rotatable to move between its-first and second positions.

24. The valve apparatus according to claim 1, wherein the carriage member is mounted within the housing to be moved along a linear path between its first and second positions.

25. The valve apparatus according to claim 1, wherein the carriage member is mounted within the housing to be moved along an arcuate path between first and second positions.

26. The valve apparatus according to claim 1, wherein the carriage member is moveable from a first position thereof towards a second position thereof to drive the shearing cutting arrangement across the flow path along an arcuate shearing cutting path.

27. A method for controlling flow along a flow path, comprising:

providing a carriage member carrying a shearing cutting arrangement and a valve member;

moving the carriage member from a first position towards a second position to drive the shearing cutting arrangement along a shearing cutting plane across the flow path and shear through an object located within the flow path, and to generally align the valve member with a valve seat; and moving the valve member relative to the carriage member to engage and/or disengage the valve seat to control flow along the flow path.

28. A valve apparatus, comprising:

a housing defining a flow path;

a valve seat located within the housing around a periphery of the flow path;

a carriage member located within the housing;

a cutting arrangement mounted on the carriage member;

a valve seat cutting arrangement; and a valve member mounted on the carriage member via a connection assembly which permits relative movement between the valve member and the carriage member, wherein the carriage member is moveable from a first position towards a second position to drive the cutting arrangement across the flow path and cooperates with the valve seat cutting arrangement to establish a transverse shear stress in an object located within the flow path, and to move the valve member into a position in which relative movement between the valve member and the carriage member permits the valve member to sealingly engage and disengage the valve seat to control flow along the flow path.

29. A valve apparatus, comprising:

a housing defining a flow path;

a valve seat located within the housing around a periphery of the flow path;

a carriage member located within the housing;

a cutting arrangement mounted on the carriage member; and a valve member mounted on the carriage member via a connection assembly which permits relative movement between the valve member and the carriage member, wherein the carriage member is moveable from a first position towards a second position to drive the cutting arrangement across the flow path and to move the valve member into a position in which relative movement between the valve member and the carriage member permits the valve member to sealingly engage and disengage the valve seat to control flow along the flow path, and wherein the cutting arrangement is moved along a cutting path during movement of the carriage member between a first position thereof and a second position thereof, wherein a clearance gap is between the cutting path of the cutting arrangement and a sealing surface of the valve seat.

* * * * *